US009779666B2

(12) United States Patent
Kwon et al.

(10) Patent No.: US 9,779,666 B2
(45) Date of Patent: Oct. 3, 2017

(54) ORGANIC LIGHT EMITTING DISPLAY AND DRIVING METHOD THEREOF

(71) Applicant: SAMSUNG DISPLAY CO., LTD., Yongin, Gyeonggi-Do (KR)

(72) Inventors: Oh-Jo Kwon, Yongin (KR); Boo-Dong Kwak, Yongin (KR); Choong-Sun Shin, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 129 days.

(21) Appl. No.: 14/518,313

(22) Filed: Oct. 20, 2014

(65) Prior Publication Data

US 2015/0130780 A1 May 14, 2015

(30) Foreign Application Priority Data

Nov. 14, 2013 (KR) ..... 10-2013-0138177

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01); *G09G 2300/0842* (2013.01); *G09G 2300/0861* (2013.01); *G09G 2320/0233* (2013.01); *G09G 2320/0295* (2013.01); *G09G 2320/043* (2013.01)

(58) Field of Classification Search
None
See application file for complete search history.

(56) References Cited

U.S. PATENT DOCUMENTS

2008/0191976 A1 8/2008 Nathan et al.
2009/0213049 A1* 8/2009 McCreary ..... G09G 3/3233 345/80
2011/0130981 A1 6/2011 Chaji et al.
2011/0185755 A1 8/2011 Kim et al.

FOREIGN PATENT DOCUMENTS

KR 10-2011-0088745 8/2011
KR 10-2012-0068684 A 6/2012

OTHER PUBLICATIONS

G. Reza Chaji, A Current-Mode Comparator for Digital Calibration of Amorphous Silicon AMOLED Displays IEEE Transactions on , vol. 55, No. 7, pp. 614-618, Jul. 2008.

* cited by examiner

*Primary Examiner* — Amr Awad
*Assistant Examiner* — Andre Matthews
(74) *Attorney, Agent, or Firm* — Lee & Morse, P.C.

(57) ABSTRACT

An organic light emitting display includes a plurality of pixels and a compensation unit. Each of the pixels includes a driving transistor to control an amount of current supplied to a corresponding organic light emitting diode. The compensation unit is coupled to the pixels by data lines and includes at least one sensing unit. The sensing unit extracts threshold voltage information from the pixels corresponding to respective driving transistors. The sensing unit receives noise currents from a plurality of data lines, offset the noise currents, and extracts the threshold voltage information after offset of the noise currents.

20 Claims, 6 Drawing Sheets

ORGANIC LIGHT EMITTING DISPLAY AND DRIVING METHOD THEREOF

CROSS-REFERENCE TO RELATED APPLICATION

Korean Patent Application No. 10-2013-0138177, filed on Nov.14, 2013, and entitled, "Organic Light Emitting Display And Driving Method Thereof," is incorporated by reference herein in its entirety.

BACKGROUND

1. Field

One or more embodiments described herein relate to a display device.

2. Description of the Related Art

The performance of displays must increase as information technology evolves. Flat panel displays have been developed in pursuit of this goal. One type of flat panel display has pixels which output light based on a recombination of electrons and holes in corresponding active layers. Displays of this type have demonstrated relatively fast response speed and low power consumption.

SUMMARY

In accordance with one embodiment, an organic light emitting display includes a plurality of pixels, each including a driving transistor to control an amount of current supplied to a corresponding organic light emitting diode; and a compensation unit coupled to the pixels by data lines, the compensation unit including at least one sensing unit to extract threshold voltage information from the pixels corresponding to respective driving transistors, wherein the at least one sensing unit is to receive noise currents from a plurality of data lines, offset the noise currents, and extract the threshold voltage information after offset of the noise currents.

The at least one sensing unit may be coupled to a first data line which is coupled to a first pixel in which the threshold voltage information of the driving transistor is to be extracted, and a second data line which is coupled to a second pixel at a same horizontal line as the first pixel. The first pixel stores a data signal may correspond to a predetermined current, and the second pixel may store a black data signal.

The at least one sensing unit may include first and second capacitors having second terminals electrically coupled to each other; a reference voltage generation unit to generate a reference voltage; a current control unit coupled to a first terminal of the first capacitor or a first terminal of the second capacitor; a comparison unit coupled to the first terminals of the first and second capacitors, the comparison unit to compare voltage values of the first and second capacitors; and a switching unit to allow the reference voltage generation unit, first capacitor, and second capacitor to be selectively coupled to the first and second data lines. The second terminals of the first and second capacitors may receive the reference voltage.

The second terminals of the first and second capacitors may be coupled to a reference power source. The current control unit may be coupled to the first terminal of the second capacitor and is to sink reference current. The reference current may be set as current to flow in the first pixel, corresponding to the data signal stored in the first pixel.

The current control unit may be coupled to the first terminal of the first capacitor and is to supply reference current. The reference current may be set as current to flow in the first pixel, corresponding to the data signal stored in the first pixel.

The switching unit may includes first switches respectively coupled between the first terminal of the first capacitor and the second data line and between the first terminal of the second capacitor and the first data line; second switches respectively coupled between the first terminal of the first capacitor and the first data line and between the first terminal of the second capacitor and the second data line; third switches respectively coupled between the reference voltage generation unit and the first data line and between the reference voltage generation unit and the second data line; and a fourth switch coupled between the current control unit and the first terminal of the first or second capacitor.

The second and third switches may be turned on during a zero-th period, the second switches may be turned on during a first period after the zero-th period, and the first and fourth switches may be turned on during a second period after the first period. The first and second periods may be set to a same duration. The first pixel may supply, to the first data line, pixel current corresponding to the data signal stored therein during the second period.

The comparison unit may output a high or low voltage, corresponding to a result obtained by comparing the voltage values of the first and second capacitors. The comparison unit may output a voltage corresponding to a difference voltage between the voltage stored in the first capacitor and the voltage stored in the second capacitor.

The display may further include a timing controller to generate a second data by changing bits of first data supplied from an external source, so that the threshold voltage of the driving transistor is compensated based on a result of the comparison unit; and a data driver to receive a second data supplied from the timing controller, to generate a data signal based on the received second data, and to supply the generated data signal to the data lines. Each of the noise currents may include a leakage current and a coupling noise current of the data lines.

In accordance with another embodiment, a method of driving an organic light emitting display includes supplying noise current of a first data line to a first capacitor; supplying noise current of a second data line to a second capacitor; supplying the noise current of the second data line to the first capacitor, supplying, to the second capacitor, the noise current of the first data line and pixel current including threshold voltage information of a driving transistor included in a first pixel coupled to the first data line; and extracting the threshold voltage information of the driving transistor in the first pixel based on a comparison of voltages of the first and second capacitors.

A data signal may be stored in the first pixel to correspond to flow of the pixel current. A reference current may be sinked from the second capacitor during supplying of the noise current to the second data line. The reference current may be set as current to flow in the first pixel, corresponding to the data signal.

The method may further include supplying reference current to the first capacitor during supplying of the noise current to the first data line. The reference current may be set as current to flow in the first pixel, corresponding to the data signal. The method may further include storing a black data signal in a second pixel coupled to the second data line and positioned on a same horizontal line as the first pixel, the black data signal stored during the supplying the noise current extracting threshold voltage information.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
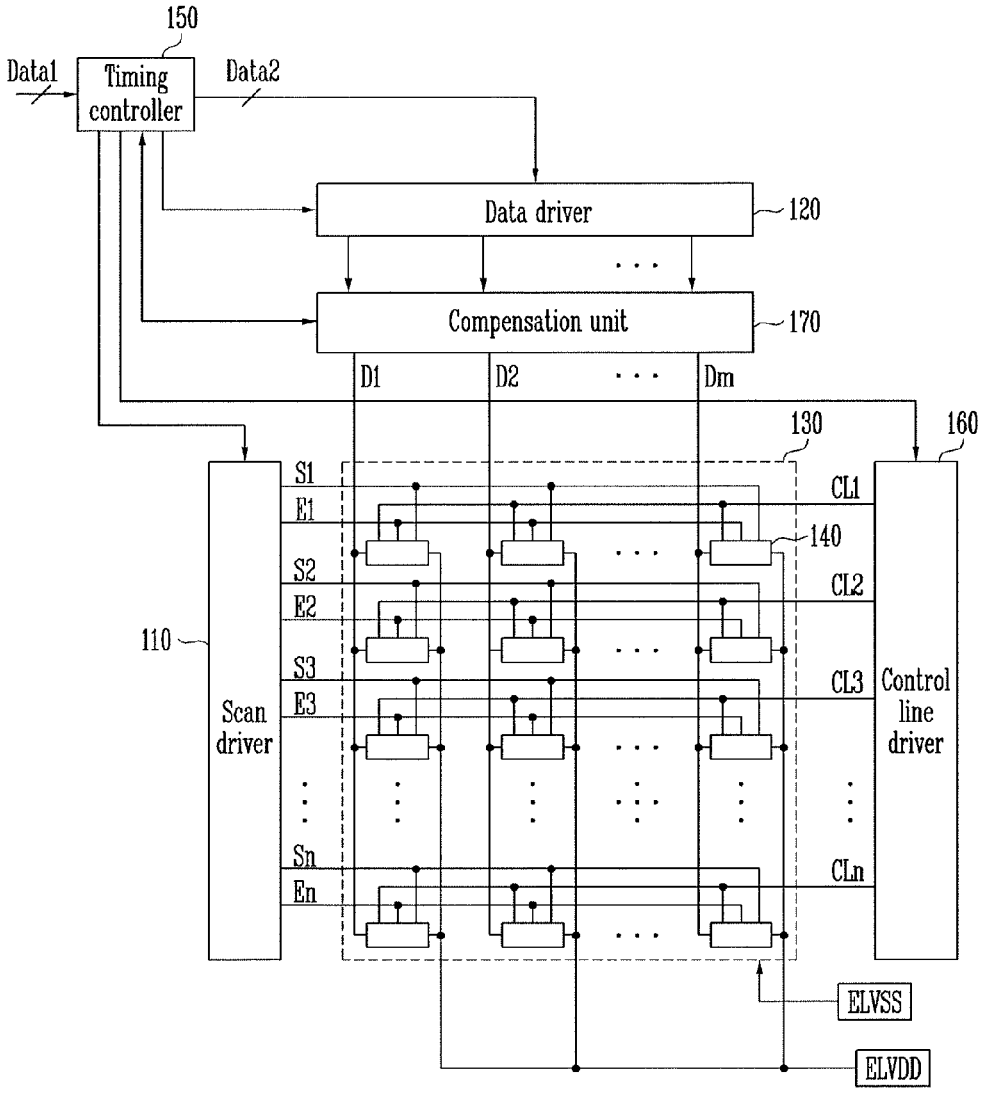
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Also, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 illustrates an embodiment of an organic light emitting display which includes a display unit 130, a scan driver 110, and a control line driver 160. The display unit includes a plurality of pixels 140 respectively positioned at intersections of scan lines S1 to Sn and data lines D1 to Dm. The scan driver 110 drives the scan lines S1 to Sn and emission control lines El to En. The control line driver 160 drives control lines CL1 to CLn.

The organic light emitting display further includes a data driver 120, a compensation unit 170, and a timing controller 150. The data driver 120 supplies data signals to the data lines D1 to Dm. The compensation unit 170 extracts, from pixels 140, degradation information and/or threshold voltage information of corresponding driving transistors. The timing controller 150 controls drivers 110, 120, and 160 and compensation unit 170.

The display unit 130 includes pixels 140 respectively positioned in areas defined by the scan lines 51 to Sn, the data lines D1 to Dm, and the control lines CL1 to CLn. The pixels 140 receive first and second power sources ELVDD and ELVSS supplied from one or more external sources. Each pixel 140 controls the amount of current supplied from the first power source ELVDD to the second power source ELVSS, via an organic light emitting diode, based on a corresponding data signal.

The scan driver 110 supplies scan signals to the scan lines S1 to Sn and emission control signals to the emission control lines E1 to En under control of the timing controller 150. For example, the scan driver 110 sequentially supplies scan signals to the scan lines S1 to Sn and sequentially supplies emission control signals to the emission control lines E1 to En under the control of timing controller 150. The scan signals may be set to voltage(s) for turning on transistors in pixels 140. The emission control signals may be set to voltage(s) for turning off transistors in pixels 140.

The control line driver 160 supplies control signals to control lines CL1 to CLn under the control of timing controller 150. For example, the control line driver 160 may sequentially supply control signals to control lines CL1 to CLn during a period in which threshold voltage information is extracted from pixels 140.

The data driver 120 generates data signals, using a second data Data2 supplied from the timing controller 150. The data driver 120 supplies generated data signals to the data lines D1 to Dm.

The compensation unit 170 extracts degradation information and/or threshold voltage information from each pixel 140. In the present embodiment, it may be possible to extract more exact threshold voltage information. The threshold voltage information extracted in the compensation unit 170 will be described in greater detail below.

When the threshold voltage information is extracted, the compensation unit 170 is coupled to k (k is 2, 4, 6, 8, . . . ) data lines Dk, and extracts threshold voltage information from k/2 pixels 140. Additionally, the compensation unit 170 allows data lines D to be coupled to the data driver 120 during a period in which the threshold voltage information is not extracted.

The timing controller 150 controls the scan driver 110, the data driver 120, the control line driver 160, and the compensation unit 170. The timing controller 150 generates a second data Data2 by changing the bit value of first data Datal (input from an external source), so that a threshold voltage of a pixel driving transistor can be compensated based on the threshold voltage information supplied from the compensation unit 170.

Figure 2:
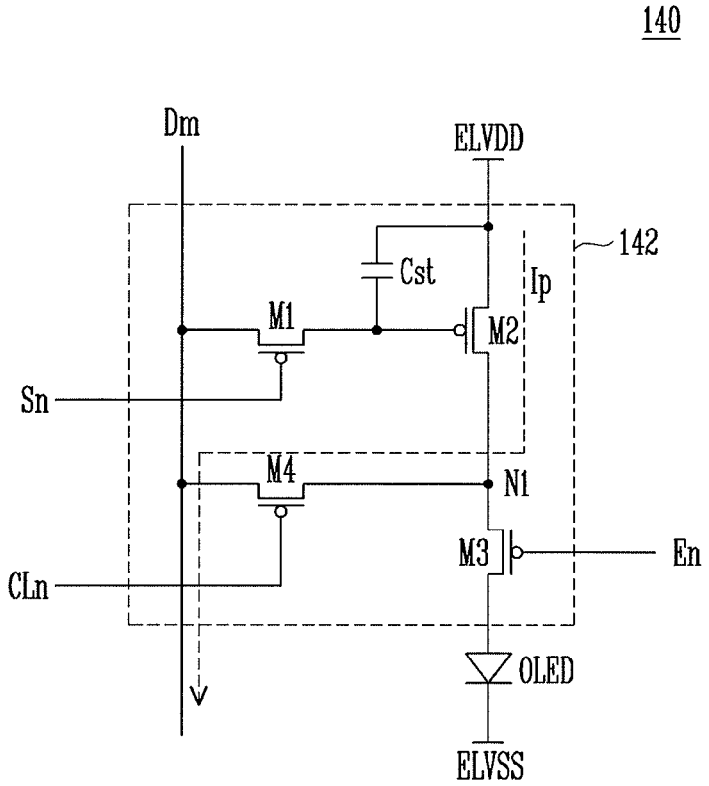
FIG. 2 illustrates an embodiment of a pixel in the display.

FIG. 2 illustrates an embodiment of pixel 140 that may be included in the display device of FIG. 1. For convenience of illustration, a pixel coupled to an n-th scan line Sn and an m-th data line Dm is shown in FIG. 2.

Referring to FIG. 2, pixel 140 includes a pixel circuit 142 to control the supply of current to the organic light emitting diode (OLED). An anode electrode of the OLED is coupled to the pixel circuit 142, and a cathode electrode of the OLED is coupled to the second power source ELVSS. The OLED generates light with a predetermined luminance based on the amount of current supplied from pixel circuit 142.

The pixel circuit 142 supplies a predetermined current to the OLED based on a data signal. In one embodiment, a predetermined voltage corresponding to a gray scale value may be supplied as the data signal. When threshold voltage information of a second transistor M2 is extracted, the pixel circuit 142 supplies the threshold voltage information of the second transistor M2 to the compensation unit 170. When the threshold voltage information is extracted, a specific data signal is supplied to the pixel circuit 142. The pixel circuit 142 supplies a predetermined pixel current Ip as the threshold voltage information to the compensation unit 170, via the data line Dm, corresponding to the specific data signal. The pixel current Ip may be different based on the threshold voltage and mobility of the second (driving) transistor M2 in each pixel 142.

In the present embodiment, pixel circuit 142 includes four transistors M1 to M4 and a storage capacitor Cst. A gate electrode of a first transistor M1 is coupled to the scan line Sn, and a first electrode of the first transistor M1 is coupled to the data line Dm. A second electrode of the first transistor M1 is coupled to a gate electrode of the second transistor M2. The first transistor M1 is turned on when a scan signal is supplied to the scan line Sn.

The gate electrode of the second (driving) transistor M2 is coupled to the second electrode of the first transistor M1, and a first electrode of the second transistor M2 is coupled to the first power source ELVDD. A second electrode of the second transistor M2 is coupled to a first node N1. The second transistor M2 controls the amount of current flowing into the first node N1 from the first power source ELVDD. The amount of current flowing into node N1 is based on a voltage applied to the gate electrode thereof, e.g., a voltage stored in storage capacitor Cst.

A first electrode of a third transistor M3 is coupled to the first node N1, and a second electrode of the third transistor M3 is coupled to the anode electrode of the OLED. A gate electrode of the third transistor M3 is coupled to an emission control line En. The third transistor M3 is turned off when an emission control signal is supplied to the emission control line En, and is turned on when the emission control signal is not supplied.

A gate electrode of a fourth transistor M4 is coupled to a control line CLn, and a first electrode of the fourth transistor M4 is coupled to the first node N1 . A second electrode of the fourth transistor M4 is coupled to the data line Dm. The fourth transistor M4 is turned on when a control signal is supplied to the control line CLn, and is turned off otherwise.

The structure of pixel 140 may be varied from the arrangement in FIG. 2, especially relating to the fourth transistor M4 for purpose of extracting the threshold voltage information of the driving transistor.

Figure 3:
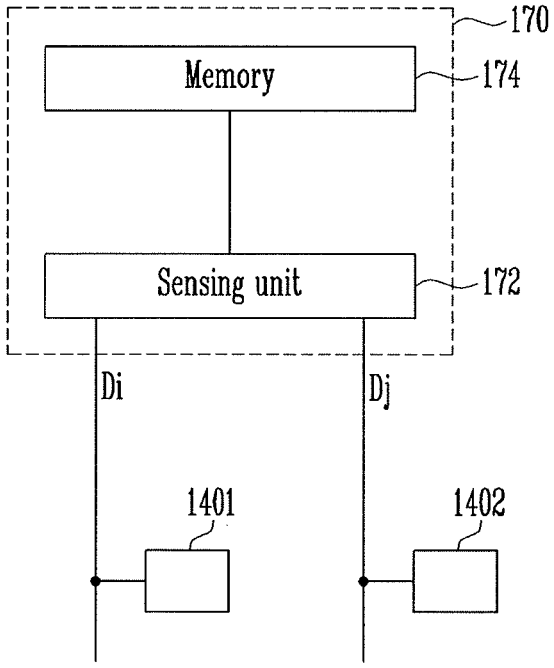
FIG. 3 illustrates an embodiment of a compensation unit.

FIG. 3 illustrates an embodiment of the compensation unit 170. For convenience of illustration, a channel coupled to an i-the (i is a natural number) data line Di and a j-th (j is a natural number except the i) data line Dj is shown in FIG. 3. In addition, a first pixel 1401 among pixels 140 coupled to the i-th data line Di and a second pixel 1402 among pixels 140 positioned on the same horizontal line as the first pixel 1401 coupled to the j-th data line Dj is shown in FIG. 3.

Referring to FIG. 3, the compensation unit 170 includes at least one sensing unit 172 and a memory 174. The sensing unit 172 is coupled to data lines Di and Dj in the example shown, and operates to extract threshold voltage information of the driving transistors in pixels 1401 and 1402, respectively coupled to data lines Di and Dj.

For example, sensing unit 172 extracts threshold voltage information of the driving transistor from first pixel 1401 coupled to i-th data line Di. When the threshold voltage information is extracted, the sensing unit 172 eliminates leakage current and coupling noise of the i-th data line Di using leakage current and coupling noise of the j-th data line Dj. In accordance with at least one embodiment, coupling noise may be understood to include current flowing so that noise of a power line (e.g., a power line supplying the first power source) is supplied to the data line by a parasitic capacitance formed in pixels 140.

The sensing unit 172 offsets the leakage current and coupling noise supplied from each of the data lines Di and Dj coupled thereto. As a result, the present embodiment is able to extract more exact threshold voltage information, e.g., without being adversely influenced or varied by noise. In this case, a specific data signal is supplied to the first pixel 1401, and a data signal corresponding to black (a gray scale of "0") is supplied to the second pixel 1402.

Additionally, the at least one sensing unit 172 may be installed in the compensation unit 170 as illustrated in FIG. 3. For example, in a case where one sensing unit 172 is in compensation unit 170, the sensing unit 172 may extract threshold voltage information of pixels 140 while being sequentially coupled to the two data lines.

Memory 174 stores the threshold voltage supplied from the sensing unit 172. In one embodiment, an analog-digital converter may be included between the memory 174 and sensing unit 172. The analog-digital converter converts the threshold voltage information of the sensing unit 172 into digital information, and supplies the converted digital information to the memory 174.

Figure 4:
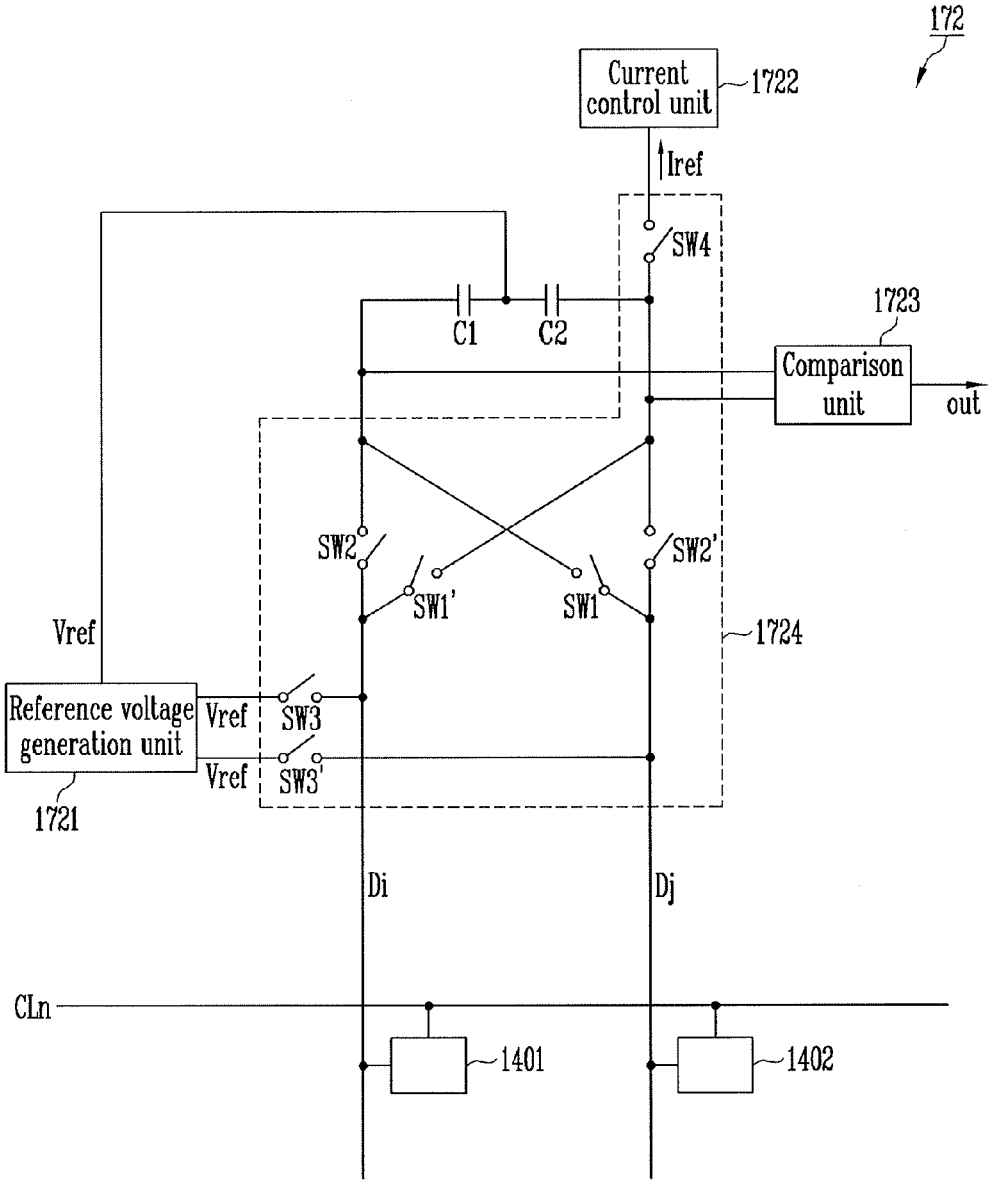
FIG. 4 illustrates an embodiment of a sensing unit.

FIG. 4 illustrates one embodiment of the sensing unit 172, which includes a reference voltage generation unit 1721, a current control unit 1722, a comparison unit 1723, a switching unit 1724, a first capacitor C1 , and a second capacitor C2. The reference voltage generation unit 1721 generates a predetermined reference voltage Vref. The reference voltage Vref is used to initialize the first capacitor C1 , the second capacitor C2, and the data lines Di and Dj.

The current control unit 1722 sinks reference current Iref. The reference current Iref may be previously set to current that is to flow in the pixels 140, which current corresponds to a specific data signal.

The comparison unit 1723 compares voltage values of the first and second capacitors C1 and C2, and outputs the result of the comparison. For example, the comparison unit 1723 may output a high or low voltage based on the comparison result of the first and second capacitors C1 and C2. The comparison unit 1723 may output a difference voltage between the first and second capacitors C1 and C2.

The switching unit 1724 includes a plurality of switches SW1, SW1', SW2, SW2', SW3, SW3', and SW4. Second switches SW2 and SW2' are coupled between first terminals of the capacitors C1 and C2 and the data lines Di and Dj, respectively. For example, the second switches SW2 and SW2' are formed between the first terminal of the first capacitor C1 and the i-th data line Di and between the first terminal of the second capacitor C2 and the j-th data line Dj, respectively.

First switches SW1 and SW1' are formed between the first terminals of the capacitors C1 and C2 and the data lines Di and Dj, respectively. For example, the first switches SW1 and SW1' are formed between the first terminal of the first capacitor C1 and the j-th data line Dj and between the first terminal of the second capacitor C2 and the i-th data line Di. That is, the first switches SW1 and SW1' are positioned so that the capacitors C1 and C2 are coupled to the second switches SW2 and SW2' through different data lines, respectively.

Third switches SW3 and SW3' are coupled between the respective data lines Di and Dj and the reference voltage generation unit 1721.

A fourth switch SW4 is coupled between the first terminal of the second capacitor C2 and the current control unit 1722.

The first terminal of the first capacitor C1 is coupled to the first and second switches SW1 and SW2. A second terminal of the first capacitor C1 is coupled to the reference voltage generation unit 1721. In this case, the reference voltage Vref is supplied to the second terminal of the first capacitor C1.

The first terminal of the second capacitor C2 is coupled to the first and second switches SW1' and SW2'. A second terminal of the second capacitor C2 is coupled to the reference voltage generation unit 1721. In this case, the reference voltage Vref is supplied to the second terminal of the second capacitor C2.

Figure 5:
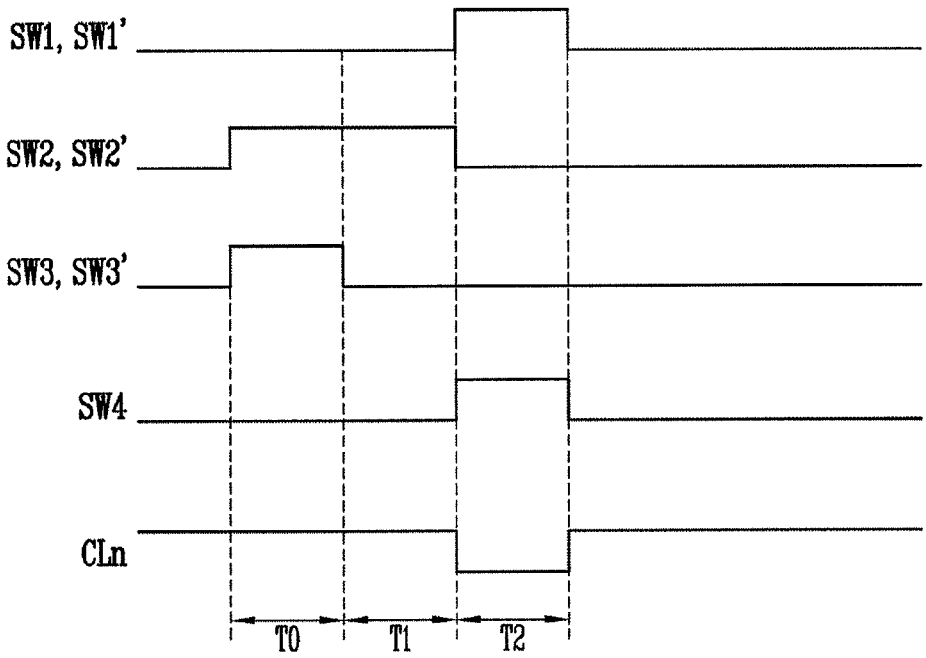
FIG. 5 illustrates an operating process of the sensing unit.

FIG. 5 is a waveform diagram illustrating an operating process of sensing unit 172. In FIG. 5, it will be assumed that a specific data signal is stored in the first pixel 1401 and a black data signal is stored in the second pixel 1402.

Referring to FIG. 5, first, second switches SW2 and SW2' and third switches SW3 and SW3' are turned on during a zeroth period T0. If the second switches SW2 and SW2' are turned on, the first capacitor C1 is coupled to the i-th data line Di and the second capacitor C2 is coupled to the j-th data line Dj. If the third switches SW3 and SW3' are turned on, the reference voltage Vref from the reference voltage generation unit 1721 is supplied to the i-th data line Di and the j-th data line Dj.

In this case, reference voltage Vref is supplied to the first and second terminals of respective ones of the first and second capacitors C1 and C2. Accordingly, the first and second capacitors C1 and C2 are initialized. The i-th data line Di and the j-th data line Dj are initialized by the reference voltage Vref.

During a first period T1, third switches SW3 and SW3' are turned off and second switches SW2 and SW2' maintain the turned-on state. If the second switches SW2 and SW2' are turned on, the first capacitor C1 is coupled to the i-th data line Di and the second capacitor C2 is coupled to the j-th data line Dj.

In this case, leakage current and coupling noise current flowing into the i-th data line Di are supplied to the first capacitor C1. Also, leakage current and coupling noise current flowing into the j-th data line Dj are supplied to the second capacitor C2. The voltage of the capacitor C1 or C2 may change in proportion to an amount supplied thereto. That is, the voltage of capacitor C1 or C2 may change in proportion to a sum of the currents. Thus, during first period T1, a voltage corresponding to the leakage current and coupling noise current supplied from the i-th data line Di is charged in the first capacitor C1. Also, a voltage corresponding to the leakage current and coupling noise current supplied from the j-th data line Dj is charged in the second capacitor C2.

During a second period T2 , first switches SW1 and SW1' and fourth switch SW4 are turned on. The fourth transistor M4 in each of the first and second pixels 1401 and 1402 is turned on corresponding to the control signal supplied to the control line CLn.

If the first switches SW1 and SW1' are turned on, the first capacitor C1 is coupled to the j-th data line Dj and the second capacitor C2 is coupled to the i-th data line Di. If the second capacitor C2 is coupled to the i-th data line Di, the pixel current Ip from the first pixel 1401 is supplied to the second terminal of the second capacitor C2. In this case, leakage current and coupling noise current of the i-th data line Di are additionally supplied to the second terminal of the second capacitor C2.

If the first capacitor C1 is coupled to the j-th data line Dj, leakage current and coupling noise current of the j-th data line Dj are supplied. Because the black data signal is supplied to the second pixel 1402, the pixel current does not flow.

If the fourth switch SW4 is turned on, the reference current Iref is sinked from the second terminal of the second capacitor C2 from the current control unit 1722. Then, second capacitor C2 charges to a voltage that corresponds to the leakage current and coupling noise current of the i-th data line Di and the current obtained by subtracting the reference current Iref from the pixel current Ip.

The current supplied to the first capacitor C1 during the first and second periods T1 and T2 may be expressed by Equation 1. The current supplied to the second capacitor C2 during the first and second periods T1 and T2 may be expressed by Equation 2.

$$C1=Il1+Il2+In1+In2 \quad (1)$$

$$C2=Il1+Il2+In1+In2+Ip-I\mathrm{ref} \quad (2)$$

In Equations 1 and 2, Il1 is indicative of leakage current during the first period T1 , Il2 is indicative of leakage current during the second period, In1 is indicative of coupling noise during the first period T1, and In2 is indicative of coupling noise during the second period T2. In Equation 2, Ip is indicative of pixel current supplied from the first pixel 1401, and Iref is indicative of reference current sunk from the current control unit 1722.

The first and second capacitors C1 and C2 respectively receive the leakage current and coupling noise current of the i-th data line Di and the leakage current and coupling noise current of the j-th data line Dj. A relationship corresponding to the case where the current supplied to the first capacitor C1 is eliminated from the current supplied to the second capacitor C2 is shown by Equation 3.

$$C2-C1=Ip-I\mathrm{ref} \quad (3)$$

That is, the second capacitor C2 is set to a voltage higher or lower by a value obtained by subtracting the reference current Iref from the pixel current Ip, as compared with the first capacitor C1. Here, the reference current Iref may be set as current that is to flow in the pixel, corresponding to a specific data signal. In the ideal case, pixel current Ip and reference current Iref may be equal, i.e., not taking variations in the threshold voltage and mobility of the driving transistor into consideration.

The comparison unit 1723 compares voltage values of the first and second capacitors C1 and C2, and outputs a value corresponding to the comparison. The comparison unit 1723 may output a high or low voltage as the comparison value. For example, comparison unit 1723 may output a high voltage when the voltage of the first capacitor C1 is higher than that of the second capacitor C2, and may output a low voltage otherwise. Memory 174 stores a value of "1" or "0" corresponding to the high or low voltage output from the comparison unit 1723.

Subsequently, the timing controller 150 generates a second data Data2 by changing the bit value of a first data Datal based on the high or low voltage stored in the memory 174. For example, the timing controller 150 may generate the second data Data2, so that the low voltage can be output corresponding to the high voltage stored in the memory 174. If the low voltage is output at a specific time after the high voltage is continuously output in the first pixel 1401, the timing controller 150 may determine that the threshold voltage of the first pixel 1401 is compensated at this time.

The comparison unit 1732 may output, as the comparison value, a voltage corresponding to a voltage difference between the first and second capacitors C1 and C2. When a voltage corresponding to the voltage difference is output as the comparison value, the corresponding voltage is converted into a digital value by an analog-digital converter, and the converted digital value is stored in the memory 174.

Subsequently, the timing controller 150 may generate the second data Data2 by changing the bit value of the first data Datal so that the threshold voltage of the pixel can be compensated based on the digital value. The threshold voltage information of the driving transistor may be extracted from each pixel 140 by repeating the process described above.

In one embodiment, the first and second periods T1 and T2 may be set to the same time. As a result, the leakage currents and coupling noise currents flowing into the data lines Di and Dj may be identically set during first and second periods T1 and T2.

As the threshold voltage information of the first pixel 1401 is extracted, the pixels 140 may be set in the black state or display a predetermined image. If the predetermined image is displayed by pixels 140, the leakage currents of the i-th data line Di and j-th data line Dj may be partially differently set (e.g., adjacent data lines may receive an almost identical gray scale data). However, when the threshold voltage information is extracted multiple times for the same pixel, the leakage currents of the i-th data line Di and j-th data line Dj may correspond to an average of this information. Accordingly, threshold voltage information may be extracted in a stable manner.

The i-th data line Di and j-th data line Dj may be arranged in various ways. For example, the i-th data line Di and j-th data line may be positioned adjacent to each other, or may be positioned with a plurality of data lines D interposed therebetween.

Figure 6:
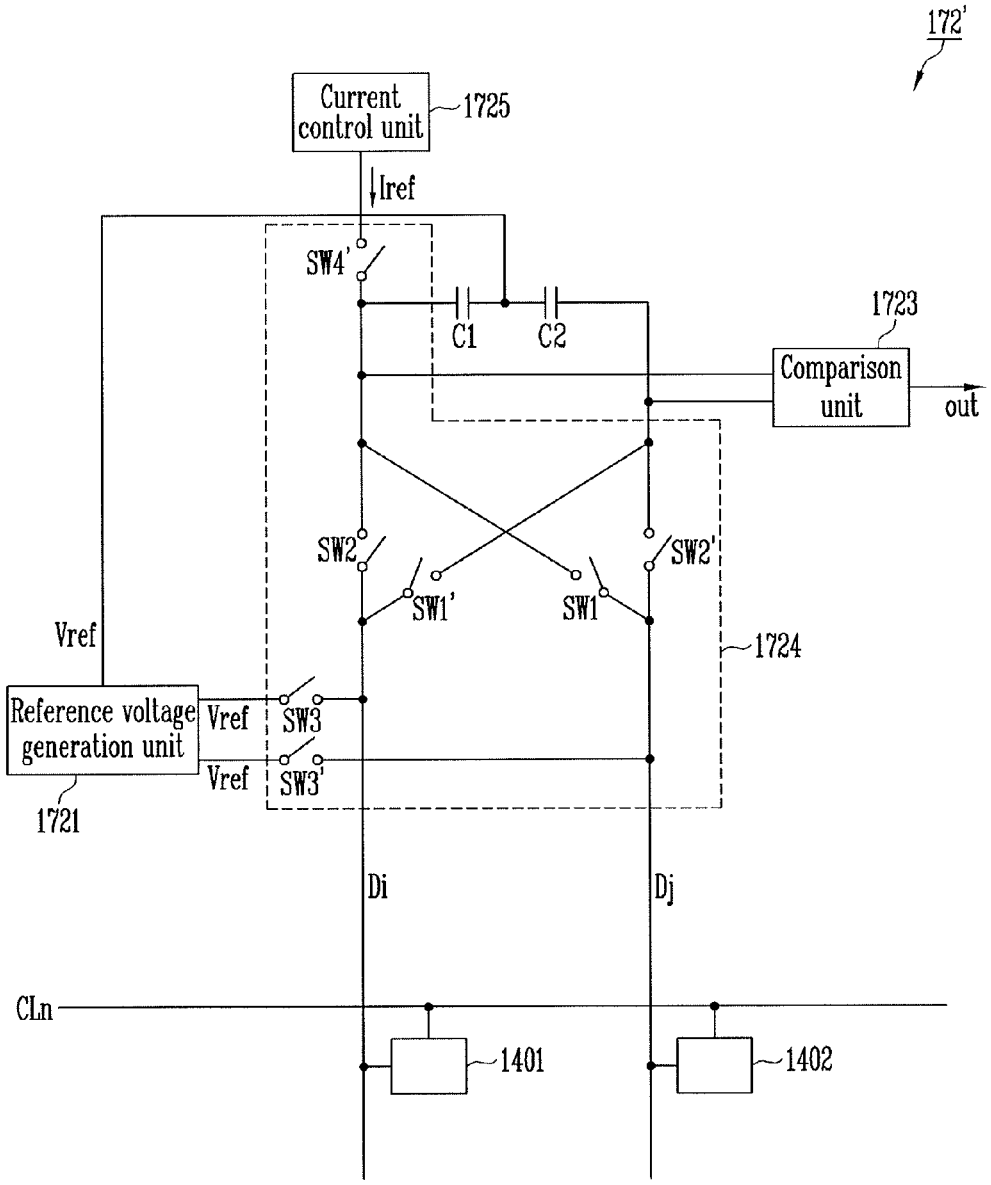
FIG. 6 illustrates another embodiment of a sensing unit.

FIG. 6 illustrates another embodiment of a sensing unit 172'. In sensing unit 172, a current control unit 1725 is coupled to the first terminal of the first capacitor C1. A fourth switch SW4' is located between the current control unit 1725 and the first capacitor C1. The fourth switch SW4' is turned on in the second period T2 of FIG. 2.

The current control unit 1725 supplies reference current Iref to the first terminal of the first capacitor C during a period in which the fourth switch SW4' is turned on. The reference current Iref is set as current to flow in the pixels 140 corresponding to a specific data signal.

When current is supplied to the first capacitor C1 from current control unit 1725, the current supplied to the first capacitor C1 during the first and second periods T1 and T2 may be expressed by Equation 4. The current supplied to the second capacitor C2 during the first and second periods T1 and T2 may be expressed by Equation 5.

$$C1=Il1+Il2+In1+In2+Iref \quad (4)$$

$$C2=Il1+Il2+In1+In2+Ip \quad (5)$$

In Equations 4 and 5, when the current supplied to the first capacitor C1 is eliminated from the current supplied to the second capacitor C2, the relation in Equation 3 is set. Subsequently, the comparison unit 1723 compares voltage values of the first and second capacitors C1 and C2, and outputs a comparison value corresponding to the compared result. The other operating process is identical to that of the aforementioned embodiment, and therefore, its detailed description will be omitted.

Figure 7:
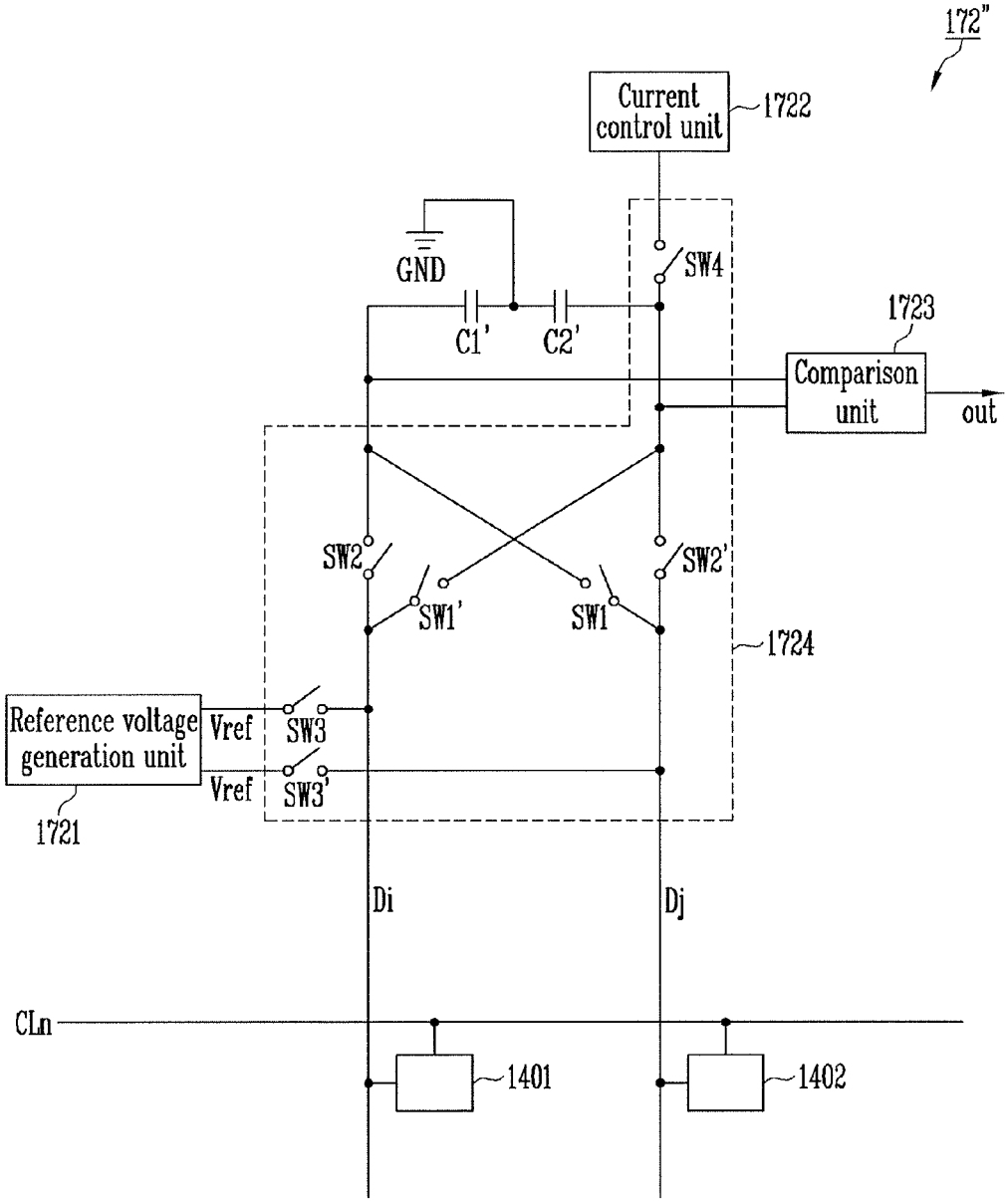
FIG. 7 illustrates another embodiment of a sensing unit.

FIG. 7 illustrates another embodiment of a sensing unit 172". In this embodiment, second terminals of first and second capacitors C1' and C2' are coupled to a ground power source GND. Each of the first and second capacitors C1' and C2' charges a predetermined voltage, corresponding to current supplied to a first terminal thereof. Thus, if the second terminals of the first and second capacitors C1' and C2' are coupled to the same fixed voltage source regardless of the voltage, the first and second capacitors C1' and C2' can be stably driven. That is, the second terminals of the first and second capacitors C1' and C2' may be coupled to various fixed voltage sources including the reference voltage Vref and the ground power source GND.

Although the transistors in the aforementioned embodiments are shown as PMOS transistors, these transistors may be implemented as NMOS transistors in other embodiments.

Also, in accordance with the aforementioned embodiments, the OLED may generate red, green, or blue light corresponding to the amount of current supplied from the driving transistor. In an implementation, the OLED may generate white light corresponding to the amount of current supplied from the driving transistor. Where the OLED generates white light, a color image may be realized using separate color filters.

By way of summation and review, an organic light emitting display includes a plurality of pixels arranged in a matrix form. The pixels are located at intersections of respective data lines, scan lines, and power lines. Each pixel includes an organic light emitting diode, two or more transistors including a driving transistor, and one or more capacitors.

Generally, organic light emitting displays have low power consumption. However, the amount of current flowing through the organic light emitting diode of each pixel depends on a variation in threshold voltage of the driving transistor. Consequently, display inequality may result. That is, the characteristic of the driving transistor may change depending on manufacturing process variables of the driving transistor in each pixel. Practically, manufacturing of the organic light emitting display so that all the transistors have the same characteristic may prove to be difficult under the current process conditions.

Various methods have been proposed to compensate for variations in the threshold voltage of a driving transistor. In one method, threshold voltage information of pixels is extracted via a data line, and data is controlled corresponding to the extracted threshold voltage information. However, when the threshold voltage information is extracted using a data line, exact information may not be extracted as a result of noise current (e.g., leakage current and/or coupling noise current) flowing into the data line. Stable compensation therefore may be difficult under these circumstances.

In accordance with one or more embodiments, leakage current and coupling noise current are extracted from multiple (e.g., each of two) data lines. The extracted leakage current and coupling noise current are offset. As a result, it may be possible to extract exact threshold voltage information of the driving transistor in the pixel, e.g., threshold voltage information unaffected by leakage current and coupling noise current. Accordingly, it may be possible to stably compensate for the threshold voltage of the driving transistor.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless specifically indicated. Accordingly, it will be understood by those of skill in the art that various changes in form and details may be made without departing from the spirit and scope of the present invention as set forth in the following claims.

What is claimed is:

1. An organic light emitting display, comprising:

a plurality of pixels including first and second pixels, each including a driving transistor to control an amount of current supplied to a corresponding organic light emitting diode; and a compensator coupled to the pixels by data lines including first and second data lines coupled to the first and second pixels, respectively, the compensator including at least one sensing circuit including first and second capacitors, the at least one sensing circuit to extract threshold voltage information from the pixels corresponding to respective driving transistors, wherein the at least one sensing circuit is to receive currents from the first and second data lines to offset a voltage corresponding to noise currents from the first and second data lines and to extract the threshold voltage information of the driving transistor of the first pixel after the noise currents of the first and second data lines are supplied to the first and second capacitors, respectively, and after the noise currents of the first and second data lines are supplied to the second and first capacitors, respectively.

2. The display as claimed in claim 1, wherein the first and second pixels are at a same horizontal line.

3. The display as claimed in claim 2, wherein:

the first pixel stores a data signal corresponding to a predetermined current, and the second pixel stores a black data signal.

4. The display as claimed in claim 2, wherein the at least one sensing circuit includes:

a reference voltage generator to generate a reference voltage;

a current controller coupled to a first terminal of the first capacitor or a first terminal of the second capacitor;

a comparator coupled to the first terminals of the first and second capacitors, the comparator to compare voltage values of the first and second capacitors; and a switching circuit to allow the reference voltage generator, first capacitor, and second capacitor to be selectively coupled to the first and second data lines, and wherein the first and second capacitors have second terminals electrically coupled to each other.

5. The display as claimed in claim 4, wherein the second terminals of the first and second capacitors receive the reference voltage.

6. The display as claimed in claim 4, wherein the second terminals of the first and second capacitors are coupled to a ground power source.

7. The display as claimed in claim 4, wherein the current controller is coupled to the first terminal of the second capacitor and is to sink reference current.

8. The display as claimed in claim 7, wherein the reference current is set as current to flow in the first pixel, corresponding to the data signal stored in the first pixel.

9. The display as claimed in claim 4, wherein the current controller is coupled to the first terminal of the first capacitor and is to supply reference current.

10. The display as claimed in claim 9, wherein the reference current is set as current to flow in the first pixel, corresponding to the data signal stored in the first pixel.

11. The display as claimed in claim 4, wherein the switching circuit includes:

first switches respectively coupled between the first terminal of the first capacitor and the second data line and between the first terminal of the second capacitor and the first data line;

second switches respectively coupled between the first terminal of the first capacitor and the first data line and between the first terminal of the second capacitor and the second data line;

third switches respectively coupled between the reference voltage generator and the first data line and between the reference voltage generator and the second data line; and a fourth switch coupled between the current control unit and the first terminal of the first or second capacitor.

12. The display as claimed in claim 11, wherein:

the second and third switches are turned on during a zero-th period, the second switches are turned on during a first period after the zero-th period, and the first and fourth switches are turned on during a second period after the first period.

13. The display as claimed in claim 12, wherein the first and second periods are set to a same duration.

14. The display as claimed in claim 12, wherein the first pixel is to supply, to the first data line, pixel current corresponding to the data signal stored therein during the second period.

15. The display as claimed in claim 4, wherein the comparator outputs a high or low voltage, corresponding to a result obtained by comparing the voltage values of the first and second capacitors.

16. The display as claimed in claim 4, wherein the comparator outputs a voltage corresponding to a difference voltage between the voltage stored in the first capacitor and the voltage stored in the second capacitor.

17. The display as claimed in claim 4, further comprising:

a timing controller to generate a second data by changing bits of first data supplied from an external source, so that the threshold voltage of the driving transistor is compensated based on a result of the comparator; and a data driver to receive the second data supplied from the timing controller, to generate a data signal based on the received second data, and to supply the generated data signal to the data lines.

18. The display as claimed in claim 1, wherein each of the noise currents includes a leakage current and a coupling noise current of the data lines.

19. A method of driving an organic light emitting display, the method comprising:

supplying noise current of a first data line to a first capacitor;

supplying noise current of a second data line to a second capacitor;

supplying the noise current of the second data line to the first capacitor, supplying, to the second capacitor, the noise current of the first data line and pixel current including threshold voltage information of a driving transistor included in a first pixel coupled to the first data line; and extracting the threshold voltage information of the driving transistor in the first pixel based on a comparison of voltages of the first and second capacitors after the noise current of the second data line is supplied to the first capacitor and after the noise current of the first data line is supplied to the second capacitor.

20. The method as claimed in claim 19, wherein:

a data signal is stored in the first pixel to correspond to flow of the pixel current, and the method includes storing a black data signal in a second pixel coupled to the second data line and positioned on a same horizontal line as the first pixel, the black data signal stored during the supplying the noise current extracting threshold voltage information.

* * * * *